US007059288B2

(12) United States Patent
Merrick et al.

(10) Patent No.: US 7,059,288 B2
(45) Date of Patent: Jun. 13, 2006

(54) RETAINER FOR CONNECTOR

(75) Inventors: Andrew D. Merrick, Lombard, IL (US); Franco Franchi, Wood Dale, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/836,291

(22) Filed: Apr. 30, 2004

(65) Prior Publication Data

US 2004/0237922 A1 Dec. 2, 2004

Related U.S. Application Data

(60) Provisional application No. 60/466,867, filed on Apr. 30, 2003.

(51) Int. Cl.
*F02P 19/00* (2006.01)
*H05B 3/06* (2006.01)
*F23Q 7/22* (2006.01)

(52) U.S. Cl. ..... 123/145 A; 24/458; 219/267; 292/17

(58) Field of Classification Search ..... 123/145 R, 123/145 A, 470; 219/267, 270; 24/296, 24/457, 458; 439/125; 292/17
See application file for complete search history.

(56) References Cited

U.S. PATENT DOCUMENTS

| | | | | |
|---|---|---|---|---|
| 2,667,004 A * | 1/1954 | Sanson | ..... | 24/106 |
| 2,779,377 A * | 1/1957 | Flora | ..... | 411/15 |
| 2,983,535 A * | 5/1961 | Henning | ..... | 292/17 |
| 3,115,225 A * | 12/1963 | Fraylick et al. | ..... | 24/297 |
| 6,539,905 B1 * | 4/2003 | Estacio et al. | ..... | 123/145 A |

FOREIGN PATENT DOCUMENTS

JP 11107898 * 4/1999

* cited by examiner

*Primary Examiner*—T. M. Argenbright
(74) *Attorney, Agent, or Firm*—Susan L. Lukasik; Dennis Kelly Sullivan; Jeffrey P. Calfa

(57) ABSTRACT

An apparatus that may be utilized as a glow plug connector (1401) includes a retainer (1601) disposed between retainer flanges (2415), advantageously in a groove (2413). The retainer (1601) is capable of compressing to fit, for example, within a passage of a rocker carrier (820) of an internal combustion engine, and capable of subsequently expanding to prevent the connector (1401) from being dislodged from the passage.

19 Claims, 14 Drawing Sheets

-PRIOR ART-

Fig. 2
-PRIOR ART-
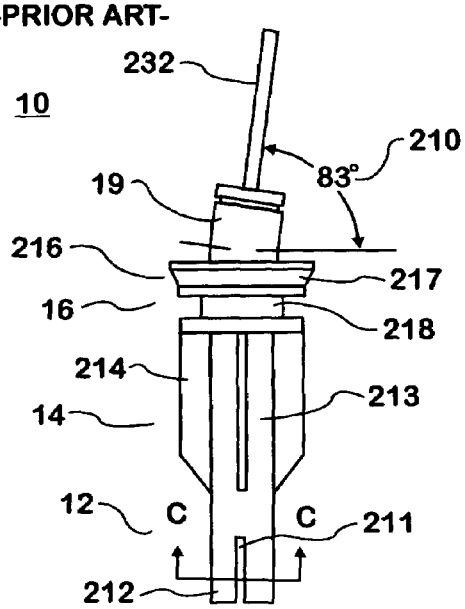
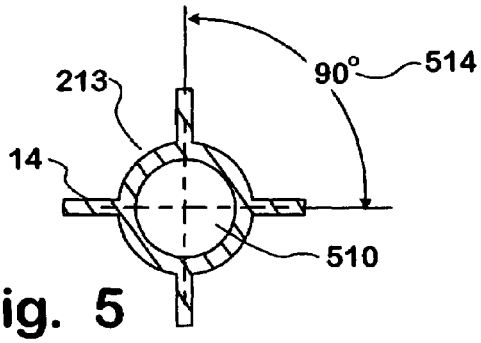
Fig. 5
SECTION B-B
-PRIOR ART-
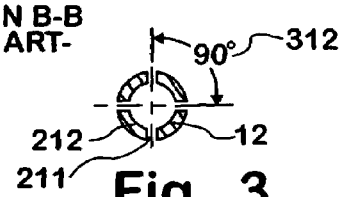
Fig. 3
SECTION C-C
-PRIOR ART-
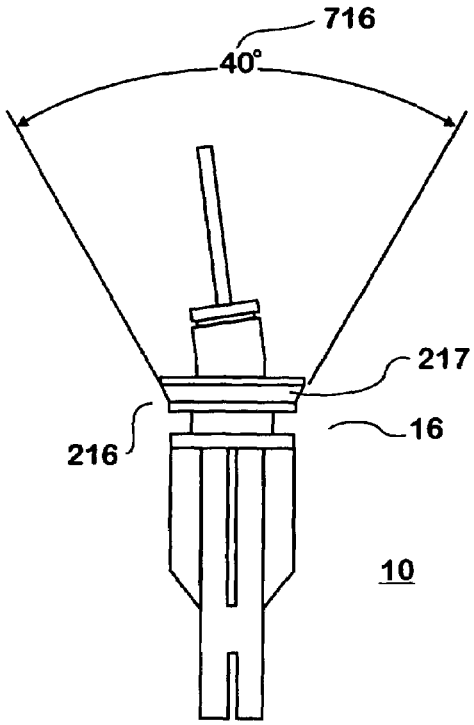
Fig. 7
-PRIOR ART-
Fig. 4
-PRIOR ART-
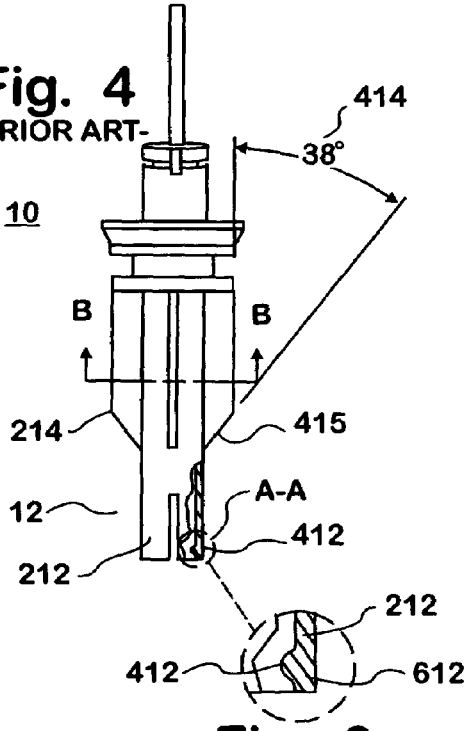
Fig. 6
VIEW A-A
-PRIOR ART-

-PRIOR ART-

-PRIOR ART-

-PRIOR ART-

-PRIOR ART-

-PRIOR ART-

-PRIOR ART-

RETAINER FOR CONNECTOR

CLAIM OF PRIORITY

This patent application claims the benefit of the priority of provisional patent application No. 60/466,867 filed Apr. 30, 2003.

FIELD OF THE INVENTION

This invention relates to glow plugs for use with internal combustion engines, including but not limited to connectors and related apparatus for use with such glow plugs.

BACKGROUND OF THE INVENTION

Internal combustion engines commonly employ cold start devices, such as a glow plug, to assist in ignition. Existing engine designs commonly have glow plugs located inside the engine valve cover. A glow plug is generally used to preheat the combustion chamber mixture of a diesel engine or an auto-ignition internal combustion engine to assist in cold starting. The single glow plug corresponding to a combustion chamber is generally secured to or installed in the cylinder head of the engine such that there is an equal number of combustion chambers and glow plugs. For example, a diesel engine with a V-8 configuration has a total of eight glow plugs with four glow plugs on each cylinder bank.

Each glow plug is typically electronically connected to a power source via a single glow plug connector attached to an under-cover valve cover wire harness. The under-cover valve cover wire harness is then appropriately electronically connected to an external engine harness that is in turn connected to an engine power source. The interface between under-valve cover and external harnesses provides a sealing function that prevents engine oil leakage. In the interior of the valve cover, the glow plug connectors, attached to the under-cover valve cover wire harness, are individually connected to corresponding glow plugs. This arrangement often times leads to crowding of engine components in the limited space under the valve cover. Also, the installation of each glow plug connector to each glow plug terminal results in increased manufacturing time and costs.

Further, mounting existing wire harness glow plug connectors individually to the glow plugs can be difficult, time consuming and requires some force to push and connect the wire harness connectors to the glow plug terminals. The wire harness connectors may be connected manually or with special insertion tools. Due to the limited space under the valve cover, it is difficult to individually install glow plug connectors properly to corresponding glow plug terminals. Many times, the resultant electrical connection between the glow plug connector and the glow plug terminal is at times not secure and electrically inadequate. As a result, electrical testing is typically required to verify that there is adequate electrical contact between the glow plug connector and the glow plug terminal. The required testing is a drawback that also leads to increased engine manufacturing time and cost.

Accordingly, there is a need for a glow plug connection apparatus that is easy to install, prevents engine oil leaks, and results in a consistently good electrical connection between the glow plug connector and glow plug, thereby reducing engine manufacturing time and costs.

U.S. Pat. No. 6,539,905

U.S. Pat. No. 6,539,905 provides a glow plug connection apparatus for electrically connecting to a plurality of glow plugs while simultaneously sealing the engine from oil leakage. The glow plug connection apparatus simultaneously installs a plurality of glow plug connectors to corresponding glow plugs mounted in a cylinder head in an internal combustion engine. The glow plug connection apparatus comprises, a rigid buss bar rail, a plurality of glow plug connectors attached to the rigid buss bar rail, a plurality of connector wires routed in the rigid buss bar rail and electrically connected to corresponding glow plug connectors, a wire router, and a conduit retaining clip between the wire router and the rigid buss bar rail. The rigid buss bar rail and the glow plug connectors preferably form an apparatus connector angle. The glow plug connector wires can terminate in a multi-port glow plug wire connector or a single connection point.

Additionally, the glow plug connector of the glow plug connection apparatus preferably comprises a buss bar rail interface section, a sealing section having an O-ring seal able to seal the glow plug connector to a glow plug passage, a guide section having a plurality of guide fins around the periphery of the glow plug connector, and a clip section having a plurality of clip fingers around the periphery of the glow plug connector able to engage a glow plug terminal. In a preferred embodiment, at least one the clip fingers has a protruding lip. The buss bar rail interface section and the glow plug connector body preferably form a glow plug connector angle.

FIG. 1 shows a front view of an embodiment of a glow plug connection apparatus 100 according to U.S. Pat. No. 6,539,905. The glow plug connection apparatus 100 comprises a rigid routing or buss bar rail 20, a plurality of glow plug connectors 10, a conduit retaining clip 25, a wire conduit 30, glow plug connector wires 32, and a glow plug wire connector 35. The glow plug connection apparatus 100 is preferably adapted for mounting in a rocker carrier 820 (shown in FIG. 8) which is mounted on a cylinder head (not shown) in an internal combustion engine. The rocker carrier is the subject of U.S. Pat. No. 6,484,683 issued Nov. 26, 2002 to Zielke. Both U.S. Pat. No. 6,539,905 and U.S. Pat. No. 6,484,683 are assigned to a common entity, International Engine Intellectual Property Company, LLC. The rocker carrier generally relates to a device for mounting and securing certain engine related components to a cylinder head, and is incorporated herein by reference.

FIG. 1 shows a four position glow plug connection apparatus 100, with four glow plug connectors 10, that would be connected to four corresponding glow plugs (shown in FIG. 10 and FIG. 11) previously mounted on a cylinder head. The glow plug connection apparatus 100 depicted in FIG. 1 and FIG. 8 is preferably mounted on the rocker carrier 820 that is mounted on one cylinder head bank side of a V-8 type engine. Those of skill in the art will readily recognize that the glow plug connection apparatus 100 could also be easily modified to cooperatively mount on a rocker carrier for use on a on a six cylinder V-type engine. The glow plug connection apparatus 100 can be modified to comprise more or less glow plug connectors 10 depending on a particular engine application, e.g., three glow plug connectors 10 for one bank of a V-6 type engine. Additionally, the glow plug connection apparatus 100 shown in FIG. 1 can be mounted on a rocker carrier 820 that is mountable on either cylinder head bank or side of a V-type engine.

The buss bar rail 20 is preferably a rigid routing section for internally routing glow plug connector wires 32 between the glow plug connectors 10 and the glow plug wire connector 35. The buss bar rail is preferably configured of a hollow lengthwise rigid metal or steel section with a rectangular cross-section. The bus bar rail 20 can have other configurations, for example a square, circular or oval cross-section. Further, the hollow rigid steel or metal makeup of the buss bar rail 20 allows the glow plugs wires 32 protects the glow plug wires 32 from heat exposure in the engine compartment due to the engine or other engine components. Also, the glow plug connection apparatus 100 via the rigid buss bar rail 20 allows the glow plug connectors 10 to be simultaneously connected by pushing or pressing down on the rigid buss bar rail 20 until the glow plug connectors 10 engage the corresponding glow plugs 900 (shown in FIG. 9).

FIG. 1 shows that the buss bar rail 20 preferably comprises four glow plug connectors 10 attached substantially equidistant and parallel to each other and extending away from the buss bar rail 20 in the same direction. The glow plug connectors 10 are preferably comprised of a buss bar rail interface section 19, a sealing section 16 with an O-ring seal 18, a guide section 14 and a clip or snap-fit section 12. The glow plug connectors 10 are appropriately spaced along the buss bar rail 20 to correspond to glow plugs 900 installed in an engine cylinder head. Further, due to the physical inclined positioning of the glow plugs 900 in the engine cylinder head, the glow plug connectors 10 preferably form an apparatus connector angle 8 with respect to the rigid buss bar rail 20. In the embodiment shown in FIG. 1, the preferred apparatus connector angle 8 is about eighty-three degrees. Those of skill in the art will readily recognize that the apparatus connector angle 8 may vary to compliment the physical inclination of the glow plugs 900 in a particular engine application. The apparatus connector angle 8 also allows the buss bar rail 20 to maintain a substantially parallel relationship to the engine cylinder head or rocker carrier once installed (shown in FIG. 8).

FIG. 1 also shows a buss bar retaining clip 25 that is preferably positioned at the interface between the rigid buss bar rail 20 and the wire router or conduit 30. The wire conduit 30 is in turn attached to the glow plug wire connector 35. The glow plug wire connector 35 is preferably a four pin connector since there are four glow plug connectors 10 which correspond to four glow plug connector wires 32. The glow plug wire connector 35 will be plugged into an external engine harness or to a glow plug control module (not shown) where power can then be appropriately delivered. The glow plug wire connector 35, wire router 30 and bus buss retaining clip 25 combination is shown attached to a left side 40 of the buss bar rail 20. Those of skill in the art will readily recognize that this combination could also be positioned on an opposite right side 50 of the buss bar rail 20 if needed by a particular engine application.

The wire router 30 is preferably a flexible dress cover for ease in moving, positioning and routing the wire router 30 in the engine compartment area. The range of movement of the wire router 30 is enhanced by the buss bar retaining clip 25 which comprises a hinge clip section 24 that moves or pivots about a middle clip point 26. The glow plug wire connector 35 can thus be more easily routed as needed and plugged into an external engine harness or glow plug control module (not shown). Both the wire router 30 and the buss bar retaining clip 25 are preferably made up of flexible plastic based materials but other materials that allow convenient routing and movement of the glow plug wire connector 35 may be substituted.

FIG. 2 shows a front view of the glow plug connector 10 of the glow plug connection apparatus 10 shown in FIG. 1. The glow plug connector 10 is preferably comprised of a buss bar rail interface section 19, a sealing section 16 for use in conjunction with an O-ring seal 18 (shown in FIG. 1), a guide section 14 and a clip or snap-fit section 12 that engages a top portion of the glow plug 913 (shown in FIG. 9). The buss bar rail interface section 19 is attached to the buss bar rail 20 as shown in FIG. 1. The buss bar interface section 19 is preferably inclined with respect to the glow plug connector body 10 by a glow plug connector angle 210. The preferred glow plug connector angle 210 is about eighty-three degrees. However, those of skill in the art will readily recognize that the glow plug connector angle 210 may vary depending on the physical inclination of the glow plugs 900 installed in a particular engine application. The glow plug connector angle 210 allows the glow plug connector 10 and the buss bar rail 20 to be attached in such a manner that the buss bar rail 20 can maintain a substantially parallel relationship to the engine cylinder head once the glow plug connection apparatus 100 is installed. This aspect results in the apparatus connector angle 8 discussed and shown in FIG. 1. Additionally, there is shown a portion of a glow plug connector wire 232 extending from the buss bar rail interface section 19 which connects the glow plug connector 10 to the glow plug wire connector 35.

FIG. 2 also shows in more detail the sealing section 16 that comprises an O-ring holder area 218 and a seating section 216. The O-ring holder area 218 is configured to hold an O-ring seal 18 (shown in FIG. 1) which will seal a glow plug passage 810 (shown in FIG. 8) in the rocker carrier. The O-ring seal 18 is preferably comprised of a rubber based material, e.g., it can be a TEFLON®-coated VITON® O-ring. Other materials that accomplish the sealing function may instead be used. The seating section 216 is preferably configured to have an external tapered seating face 217. The tapered seating face 21 engages a complimentarily configured top glow plug passage section 816 (shown in FIG. 8) of the rocker carrier 820 when the glow plug connection apparatus 100 is installed. The O-ring seal 18 and the tapered seating face 217 allow the glow plug connectors 10 to be appropriately sealed in the rocker carrier 820 and to properly sit on the top glow plug passage 816 when the glow plug connection apparatus 100 is installed (shown in FIG. 8).

FIG. 2 also shows the guide section 14 which is preferably comprised of a plurality of guide fins 214 positioned in a substantially vertical manner around the periphery of a glow plug connector midsection 213. The guide fins 214 will appropriately align or position the glow plug connector 10 in glow plug passages 810 (shown in FIG. 8) to allow the glow plug connectors 10 to more easily travel in the glow plug passages 810 and thereby more easily and properly connect with the glow plugs 900 installed in the cylinder head (not shown). The guide fins 214 also give the glow plug connector 10 added structural strength and stability. The preferred embodiment shown in FIG. 2 comprises four guide fins 214 (shown in FIG. 5) spaced equidistantly at about 90 degrees from each other around the periphery of the connector midsection 213 for positioning of the glow plug connectors 10. Those of skill in the art will readily recognize that more or less fins could be used to accomplish the same function. Also, the degree distance 514 (shown in FIG. 5) between the guide fins 214 may be different from guide fin 214 to guide fin 214 so long as the proper positioning of the glow plug connector 10 in the glow plug passage 810 is achieved.

Further, FIG. 2 shows the glow plug clip section 12 at the bottom of the glow plug connector 10. The glow plug clip section 12 is preferably comprised of a plurality of clip fingers 212 positioned around the bottom periphery of the glow plug connector 10. In the embodiment shown, the glow plug clip section 12 comprises four clip fingers 212 (shown in FIG. 3) spaced equidistantly from each other around the bottom periphery of the glow plug connector 10. This physical arrangement results in finger spacings 211 between the clip fingers 212 that are equidistantly spaced at 90 degrees from each other (shown in FIG. 3). The equidistant finger spacings 211 allow for more efficient or equal distribution of forces encountered by the clip fingers 212. The clip fingers 212 preferably have a resilient and spring-like property so that they can expand and contract as required when a glow plug 900 is inserted into or removed from the glow plug connector 10. During installation of the glow plug connection apparatus 100, the clip fingers 212 expand to accept a glow plug terminal 912 (shown in FIG. 12) and then contract to secure the electrical connection to the glow plug terminal 912. Those of skill in the art will readily recognize that more or less clip fingers 212 could be used so long as the desired electrical connection of the glow plug connector 10 to the glow plug 900 is achieved and secured. Though equidistant spacing is preferred, the resultant finger spacings 211 between clip fingers 212 could be different from clip finger 212 to clip finger depending on a particular application.

FIG. 3 shows a cross-sectional view of the clip section 12 along a section line C—C of the glow plug connector 10 shown in FIG. 2. FIG. 3 clearly illustrates that in a preferred embodiment, the glow plug connector 10 clip section 12 is comprised of four clip fingers 212 equidistantly positioned around the periphery of a glow plug connector 10 and separated by four resulting finger spacings 211. The finger spacing 211 are preferably equidistantly spaced at 90 degrees apart from each other. The equidistant clip finger 212 arrangement allows for more efficient or equal distribution of forces encountered by the clip fingers 212 when a glow plug 900 is inserted or removed upon installation or removal of the glow plug connection apparatus 100.

FIG. 4 shows a side view of the glow plug connector shown in FIG. 2. A preferred configuration of the guide fins 214 is illustrated where the guide fin bottom 415 has an inclined construction. In this embodiment, the guide fin bottom 415 forms a fin angle 414 with the glow plug connector 10 of about 38 degrees. The guide fin angle 414 will ease the initial insertion of the glow plug connectors 10 into the glow plug passages 810 of the rocker carrier 820 (shown in FIG. 8). Those of skill in the art will recognize that other guide fin angles 414 would also accomplish the same function. FIG. 4 also shows a cutaway view A—A of the glow plug clip section 12 that partially highlights a preferred interior protruding lip 412 configuration of the clip fingers 212. The protruding lip 412 is an important part of the clip fingers 212 since it 412 is in part responsible for holding and securing the electrical connection between the glow plug connectors 10 to the glow plug 900.

FIG. 5 shows a cross-sectional view of the guide section 14 along the section line B—B of the glow plug connector 10 shown in FIG. 4. FIG. 5 shows that in the preferred embodiment, the glow plug 10 is comprised of four guide fins 214 spaced equidistantly at 90 degrees from each other around the periphery of the connector midsection 213. As noted previously, the guide fins 214 properly align or position the glow plug connector 10 in the glow plug passages 810 of the rocker carrier 820. More or less guide fins 214 could be used and the degree distance 514 between the guide fins 214 may be different from guide fin 214 to guide fin 214 so long as the proper alignment or positioning of the glow plug connector 10 in the glow plug passage 810 is achieved. FIG. 5 also shows the glow plug connector interior 510 which will preferably house a female type connector 1010 (shown in FIG. 10 and FIG. 11). The female type connector 1010 is internally electrically connected (not shown) to the glow plug connector wire 32 (shown in FIG. 1) and accepts the insertion of the glow plug terminal tip 914 (shown in FIG. 9 and FIG. 11).

FIG. 6 shows an enlarged detail of view A—A of the clip section 12 of the glow plug connector 10 showing a preferred interior configuration of the clip finger 212. The interiorly protruding lip 412 is an important aspect of the clip fingers 212. In conjunction with the resilient and spring-like nature of the clip fingers 212, it is the protruding lip 412 that is responsible for ultimately holding and securing the electrical connection between the glow plug connectors 10 to the glow plug 900. The protruding lip 412 preferably extends along the interior periphery of the clip finger 212 near the finger bottom 612 and each clip finger 212 preferably has a protruding lip 412. This allows for a better and more secure connection between the glow plug connectors 10 to the glow plug 900. Those of skill in the art will readily recognize that the protruding lip 412 could also extend only partially along the interior of the clip finger 212 or could be present in less than all the clip fingers 212. The preferred configuration of the clip fingers 212 results in a "snap-on" or "click-on" feature that allows an operator or installer to know when the glow plug connectors 10 are properly installed on the glow plugs 900.

FIG. 7 shows a rear view of the glow plug connector shown in FIG. 2. More particularly, FIG. 7 shows that the seating section 216 has a tapered seating face angle 716, which is preferably about 40 degrees. The tapered seating face 217 will interact with a complimentarily configured top glow plug passage section 816 of the glow plug passage 810 (shown in FIG. 8). The tapered seating face 217 allows the glow plug connectors 10 to properly sit on or engage the top glow plug passage section 816 of the glow plug passage once the glow plug connection apparatus 100 is installed (shown in FIG. 8). The tapered seating face angle 716 may take on other values complimentary to the top glow plug passage section 816.

FIG. 8 shows an embodiment of the rigid glow plug connection apparatus 100 mounted on a rocker carrier 820 with a valve cover 830, where the four glow plug connectors 10 are preferably mounted in the respective glow plug passages 810 of the rocker carrier 820. There is shown a rocker carrier 820 adapted for use with a cylinder head (not shown) in an internal combustion engine, e.g., on either engine bank or side of a V-8 type diesel engine. There is also shown a valve cover 830 that secures to the top periphery 827 of the rocker carrier 820 to thereby enclose the cylinder head. One of the various features of the rocker carrier 820 is that rocker arm assemblies with associated rocker arms (not shown) and other related components can be mounted to the rocker carrier 820.

Among other configurations, the rocker carrier 820 comprises a plurality of glow plug passages 810 in or adjacent to a front rocker carrier wall 825. The glow plug passages 810 preferably have an inclined or angled configuration in the front wall 825 of the rocker carrier 820. In this manner, the glow plug passages 810 are complimentary to the angled or inclined glow plug connectors 10 of the glow plug connection apparatus 100. There is also shown the inclined nature of the top glow plug passage section 816 of the glow plug passage 810. The top glow plug passage section 816 is preferably configured or angled to compliment the angled or inclined tapered seating face 217 (shown in FIG. 2) of the glow plug connector 10 sealing section 16. In this manner, the connection to the glow plugs 900 (shown in FIG. 9 through FIG. 11) can be appropriately sealed via the O-ring seal 18 (shown in FIG. 1) on the sealing section 16.

In order to install the glow plug connection apparatus 100 (also shown in FIG. 2), an installer preferably positions the buss bar rail 20 such that all the glow plug connectors 10 are inserted into the appropriate glow plug passages 810 of the rocker carrier 820. Next, the installer pushes or presses downward on the rigid buss bar rail 20 which thereby applies simultaneous force on the glow plug connectors 10. The glow plug guide sections 14, via the guide fins 414, align the glow plug connectors 10, as force is applied, for proper electrical connection to the glow plug terminal 912. This allows the glow plug connectors 10 to be simultaneously connected when the glow plug connectors 10 engage corresponding glow plug terminals 914 on the glow plugs 900 (shown in FIG. 9).

As the glow plug connectors 10 are pushed into place, the each glow plug terminal 912 enters the connector clip section 12. As the glow plug connector 10 continues moving downward, the glow plug clip fingers 212 encounter the glow plug terminal head 913. At this point, the configuration of the glow plug terminal head 913 forces the clip fingers 212 to expand as they continue to travel downward. When the clip section 12 reaches the glow plug terminal neck 915 the clip fingers 212 will rapidly contract and compressively seat around the periphery of the glow plug terminal neck 915. This rapid contraction results in a "snap" or "click" that typically should be audible to the installer. The installer also should be able to "feel" when the clip fingers have snapped onto the glow plug 900. Thus, the installer will know that there is a good electrical connection when he hears or "feels" the glow plug connectors 10 "snap-on" or "click-on" to the glow plug terminals 912.

At this point, the glow plug terminal tip 914 is inserted and electrically connected to the female type connector 1010 in the glow plug connection interior (shown in FIG. 10 and FIG. 11) which is in turn connected (not shown) to the glow plug connector wire 32 (shown in FIG. 1). Also, the glow plug connectors 10 are now appropriately sealed against the glow plug passages 810 via the O-ring seal 18 and tapered seating face 217 of the sealing section 16 acting on the top glow plug passage section 816. If the glow plug connectors 10 are not properly installed, the O-ring seal should be visible. This is a signal to the installer that the glow plug connection apparatus needs to be reinstalled. Further, the rigid buss bar rail 20 should now be substantially parallel to the engine cylinder head (not shown) upon which the rocker carrier 820 is or will be installed. The rigid buss bar rail 20 is preferably parallel to the engine cylinder head to, among other things, minimize the amount of space used in the engine compartment. The glow plug wire connector 35 can now be plugged into an external engine harness, glow plug control module or other appropriate engine component for delivery of power to the glow plugs.

FIG. 9 shows a typical glow plug 900 that could be used with the glow plug connectors shown in FIG. 1 through 8. The glow plug 900 generally comprises a glow plug terminal 912, a cylindrical metal glow plug tube or body 905 and a heating element 903. The cylindrically tube 905 comprises the housing of the glow plug 900 that attaches to the cylinder head or engine block (not shown). The glow plug 900 is preferably threaded to the cylinder head or engine block via glow plug threads 907 on the exterior of the glow plug 900. The is also a glow plug terminal 912 at the top of the glow plug 900 that is insulated 908 from the glow plug body 905 and electrically connected to the heating element 903. The glow plug terminal 912 is comprised of a terminal tip 914, a terminal head 915 and a terminal neck 915. The heating element 903 is generally comprised of a ceramic heating element tip 903 that will heat up when power or electric current is applied to the glow plug terminal 912 to provide heat to the diesel mixture in the combustion chamber (not shown).

As discussed previously with respect to FIG. 8, the glow plug terminal tip 914 is inserted and electrically connected to the female type connector 1010 (shown in FIG. 10 and FIG. 11) which is in turn connected (not shown) to the glow plug connector wire 32 (shown in FIG. 1). Also, the configuration of the glow plug terminal head 913 forces the resilient connector clip fingers 212 to expand as they travel around the terminal head 913. When the resilient connector clip section 12 reaches the glow plug terminal neck 915, the resilient connector clip fingers 212 rapidly contract and compressively seat around the periphery of the glow plug terminal neck 915. The installer will hear or "feel" when the connector clip fingers 212 snap or click onto the glow plug 900. The configuration of the glow plug terminal 914 and the make up of the glow plug connector 10 allows the installer to know when there is a good electrical connection when he/she hears or "feels" the glow plug connectors 10 "snap-on" or "click-on" to the glow plug terminal neck 915.

FIG. 10 shows a front view of an embodiment of the glow plug connection apparatus 100 with an installed glow plug 900. FIG. 10 shows three glow plug connectors 10 attached to the rigid buss bar rail 20 in a substantially equidistant and parallel manner and extending away from the buss bar rail 20. FIG. 10 also depicts a cutaway glow plug connector 1012 with a female type connector 1010 which is housed in the glow plug connector interior 510 (shown in FIG. 5). The female type connector 1010 is internally electrically connected (not shown) to the glow plug connector wire 32 (shown in FIG. 1) and accepts the insertion of the glow plug terminal 912 (shown in FIG. 11). There is also shown the clip fingers 212 of the snap fit section 12 that will additionally secure the glow plug connector 10 to the glow plug 900 at the glow plug terminal 912.

FIG. 11 shows the cutaway glow plug connector 1012 of FIG. 10 with an installed glow 900. FIG. 11 shows that the terminal tip 914 of the glow plug terminal 912 is inserted in the female type connector 1010 of the glow plug connector 1012. FIG. 11 also shows that the clip fingers 212 extend past the glow plug terminal head 913 and down to the glow plug terminal neck 912 to secure and connect the glow plug connectors 10 and 1012 to the glow plug 900.

FIG. 12 shows a perspective front view of an alternate embodiment of the glow plug connection apparatus 1200 adapted for mounting in a rocker carrier 820, similar to that shown in FIG. 8. The embodiment of the glow plug connection apparatus 1200 shown in FIG. 12 preferably comprises a rigid buss bar rail 1220, a plurality of glow plug connectors 1210, glow plug connector wires 1232, and a glow plug wire connector 1235. The rigid bus bar rail 1220, of this embodiment, additionally comprises strengthening and support sections 1222. The rigid buss bar 1220 has four glow plug connectors 1210 attached in a substantially equidistant and parallel manner and extending away from the buss bar rail 1220 in the same direction. The glow plug connectors 10 are preferably comprised of a buss bar rail interface section 1219, a sealing section 1216 with an O-ring seal 1218, a guide section 1214 and a clip or snap-fit section 1212 that engages the glow plug 900 (similar to that shown in FIG. 10). The glow plug connection apparatus 1210 is connected to the rocker carrier 820 (shown in FIG. 8) and the glow plugs (shown in FIG. 9) in a fashion as previously described in FIG. 8.

FIG. 13 shows a partial view of an alternate embodiment of the termination of the glow plug connector wires 1332. In this embodiment, the glow plug connector wires 1332 preferably terminate at a single connection point 1335 instead of a multi-port glow plug wire connector 35 and 1235 as depicted in FIG. 1 and FIG. 12. In this embodiment, the glow plug connector wires 1332 have a single termination point thus power or electrical current is either provided to all or none of the glow plugs 900 (not shown) simultaneously. This is a configuration that could be useful in some engine applications.

BRIEF DESCRIPTION OF THE DRAWINGS

FIG. 1 through FIG. 13 illustrate a glow plug connection apparatus in various views from U.S. Pat. No. 6,539,905.

DETAILED DESCRIPTION

The following describes an apparatus for and method of connecting wires to a glow plug. A harness assembly includes a plurality of glow plug connectors, each of which connects to a glow plug for an internal combustion engine. The harness assembly and glow plug connectors described herein may be modified for use with spark plugs and engine sensors, including multi-wire sensors.

Figure 14:
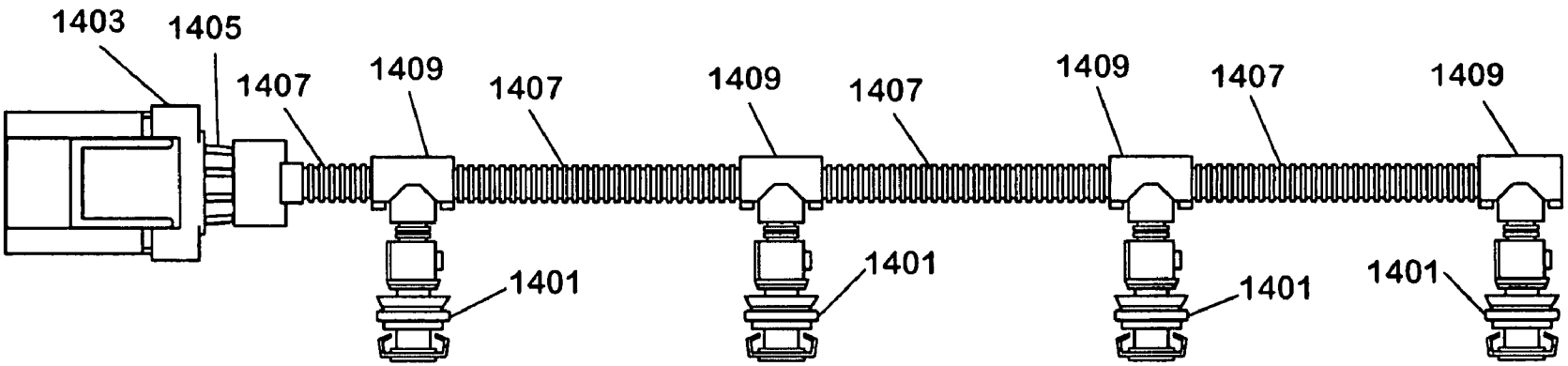
FIG. 14 is a harness assembly in accordance with the invention.
Figure 15:
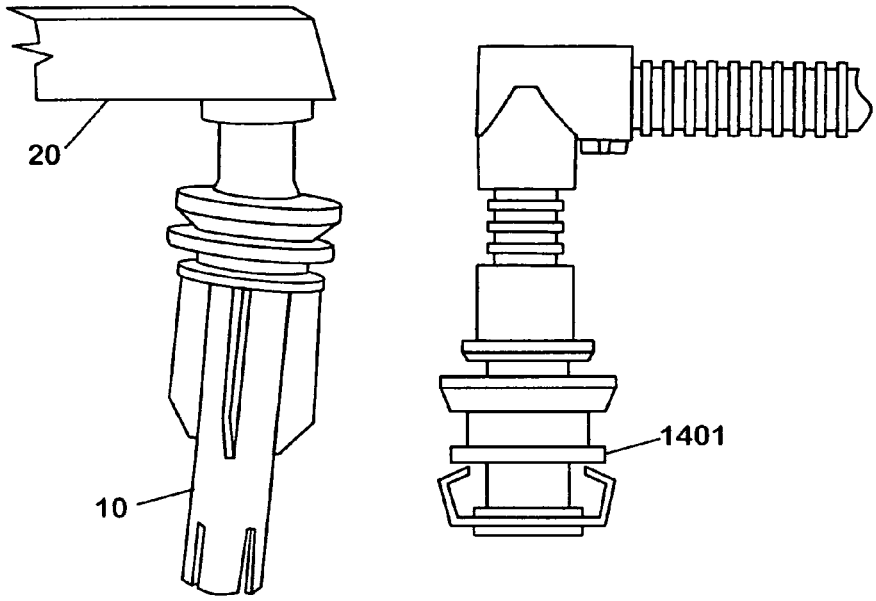
FIG. 15 is a close-up of the glow plug connector in accordance with the invention.

FIG. 14 shows a harness assembly 1400 for a plurality of glow plug connectors 1401. The harness assembly 1400 includes a glow plug wire connector 1403 that connects a power source to glow plug wires 1405 for each of the glow plug connectors 1401. The glow plug wires 1405 extend through a wire conduit 1407, which may be flexible or rigid wire conduit, and a T-connector 1409 for each glow plug connector 1401. A close-up of the glow plug connector 1401 is shown in FIG. 15.

Figure 16:
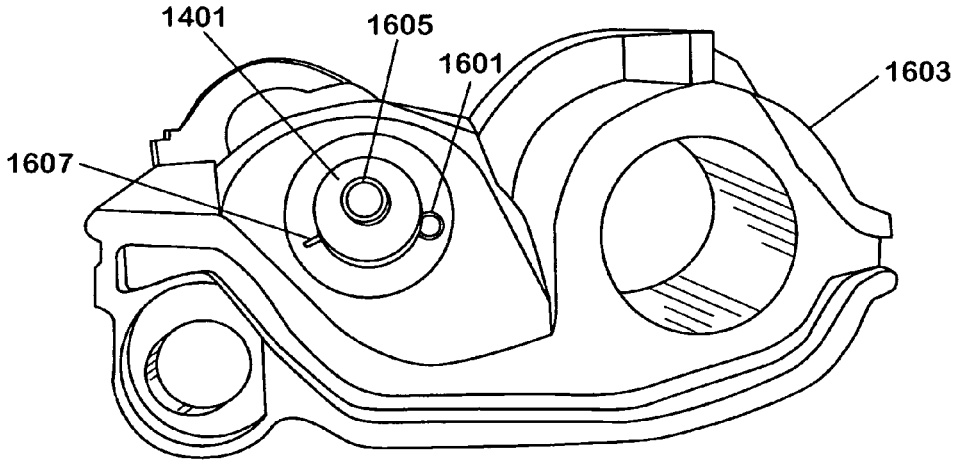
FIG. 16 is a properly inserted glow plug connector within a part of a rocker carrier 1603 in accordance with the invention.

FIG. 16 illustrates a properly inserted glow plug connector 1401 within a part of a rocker carrier 1603, as viewed from inside the rocker carrier 1603 where the glow plugs are disposed. Inside each glow plug connector 1401 is a glow plug terminal 1605 that provides electrical connection to the glow plug, as shown in FIG. 16. A retention arm 1607 that is part of a retainer 1601 is also shown.

Figure 17:
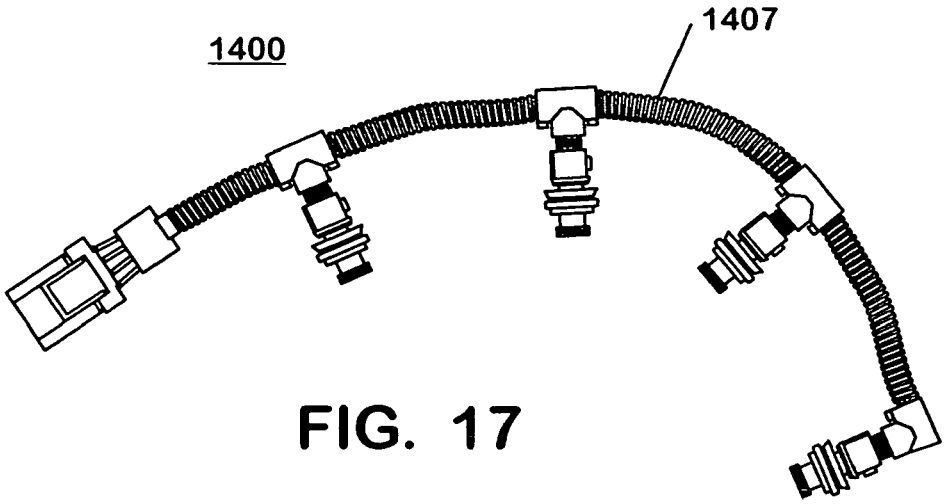
FIG. 17 is a harness assembly that utilizes flexible wire conduit in accordance with the invention.
Figure 18:
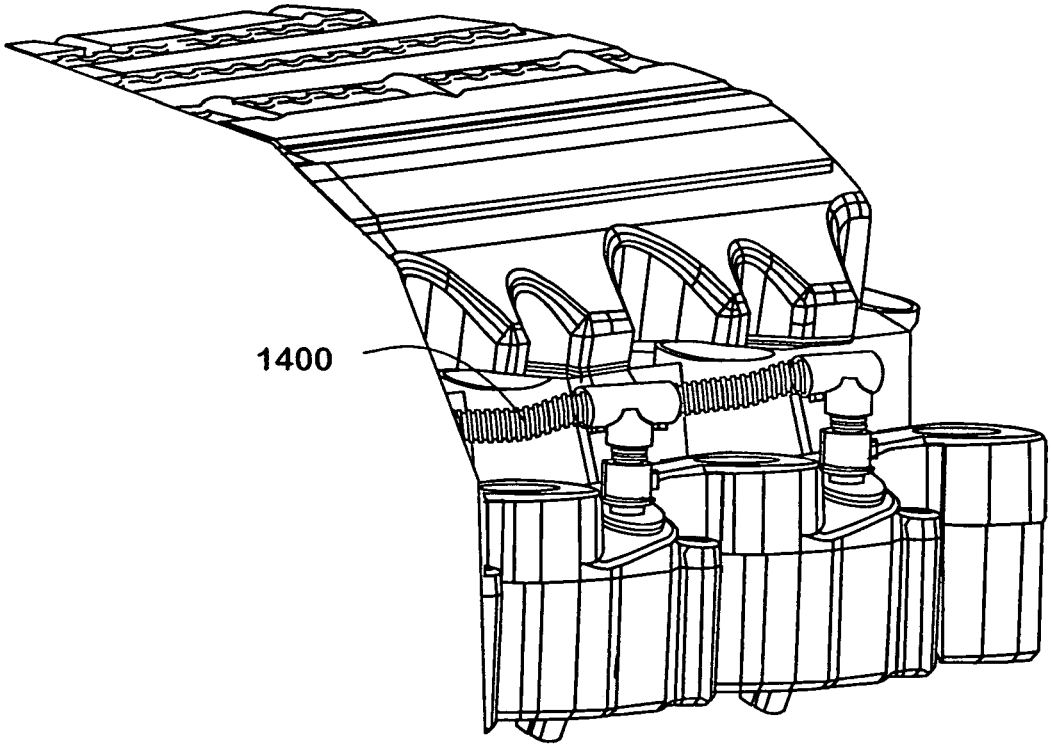
FIG. 18 and FIG. 19 illustrate the harness assembly with each glow plug connector inserted into the rocker carrier in accordance with the invention.
Figure 19:
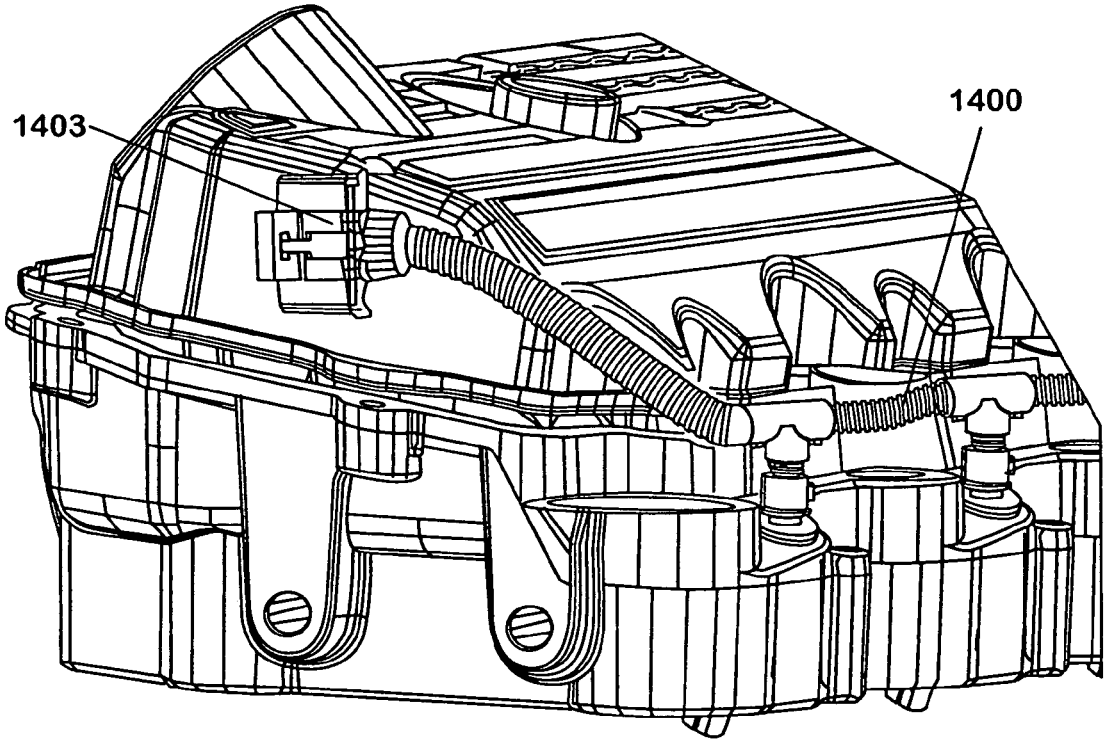

FIG. 17 shows a harness assembly 1400 that utilizes flexible wire conduit 1407. FIG. 18 and FIG. 19 illustrate the harness assembly 1400 with each glow plug connector 1401 inserted into the rocker carrier 1603 of an internal combustion engine. The harness assembly 1400 and/or glow plug connectors 1401 described herein may be utilized, for example, with V-type, inline, or L-type engines.

Figure 20:
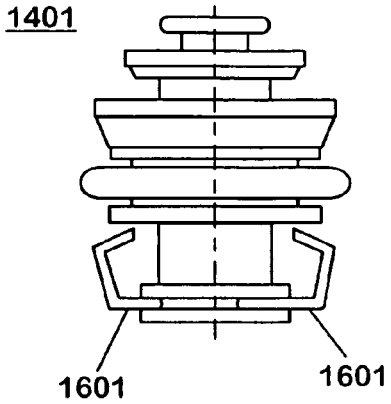
FIG. 20 is a side view of the glow plug connector with a retainer installed in accordance with the invention.
Figure 21:
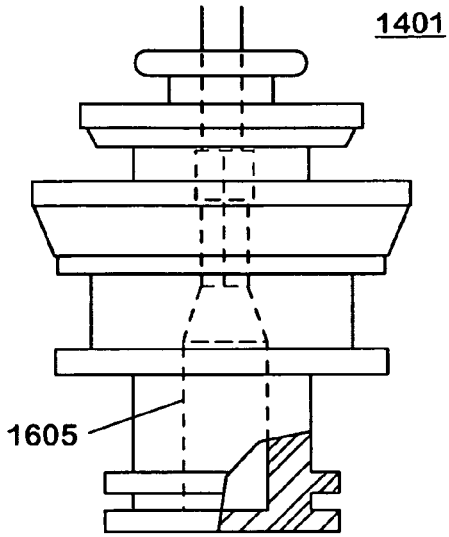
FIG. 21 is an inner glow plug terminal disposed within the glow plug connector in accordance with the invention.
Figure 22:
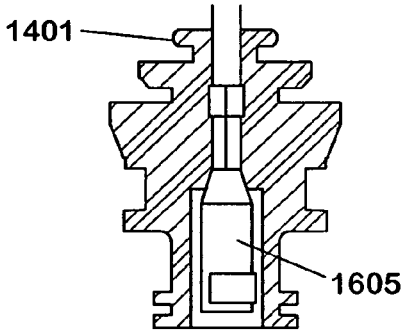
FIG. 22 is a cross-sectional view of the connector showing the glow plug terminal in relation to the glow plug connector in accordance with the invention.

FIG. 20. is a side view of the glow plug connector 1401 with the retainer 1601 installed. FIG. 21 illustrates the inner glow plug terminal 1605 disposed within the glow plug connector 1401. FIG. 22 is a cross-sectional view of the glow plug connector 1401 showing the glow plug terminal 1605 in relation to the connector 1401. The part of the glow plug connector 1401 that surrounds the glow plug terminal 1605 may be comprised of velox material.

Figure 23:
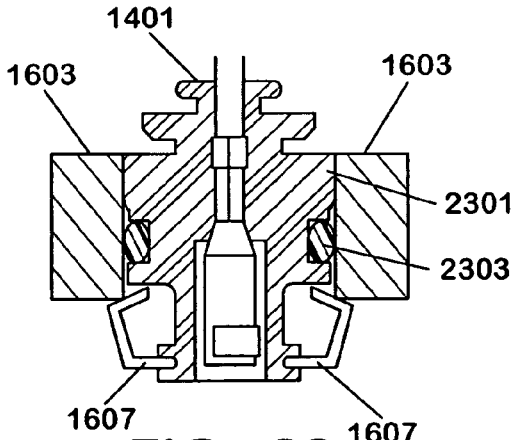
FIG. 23 is illustrates a cross-section of the glow plug connector disposed within a rocker carrier in accordance with the invention.

FIG. 23 illustrates a cross-section of the glow plug connector 1401 disposed within an opening in a rocker carrier 1603, showing compression of an O-ring seal 2303 and a stopper 2301. Once the outer diameter of the O-ring seal 2303 is no longer visible above the rocker carrier 1603, the glow plug connector 1401 is properly mounted. Once the glow plug connector 1401 is installed, retention arms 1607 for the retainer 1601 expand below the surface of the rocker carrier 1603.

Figure 24:
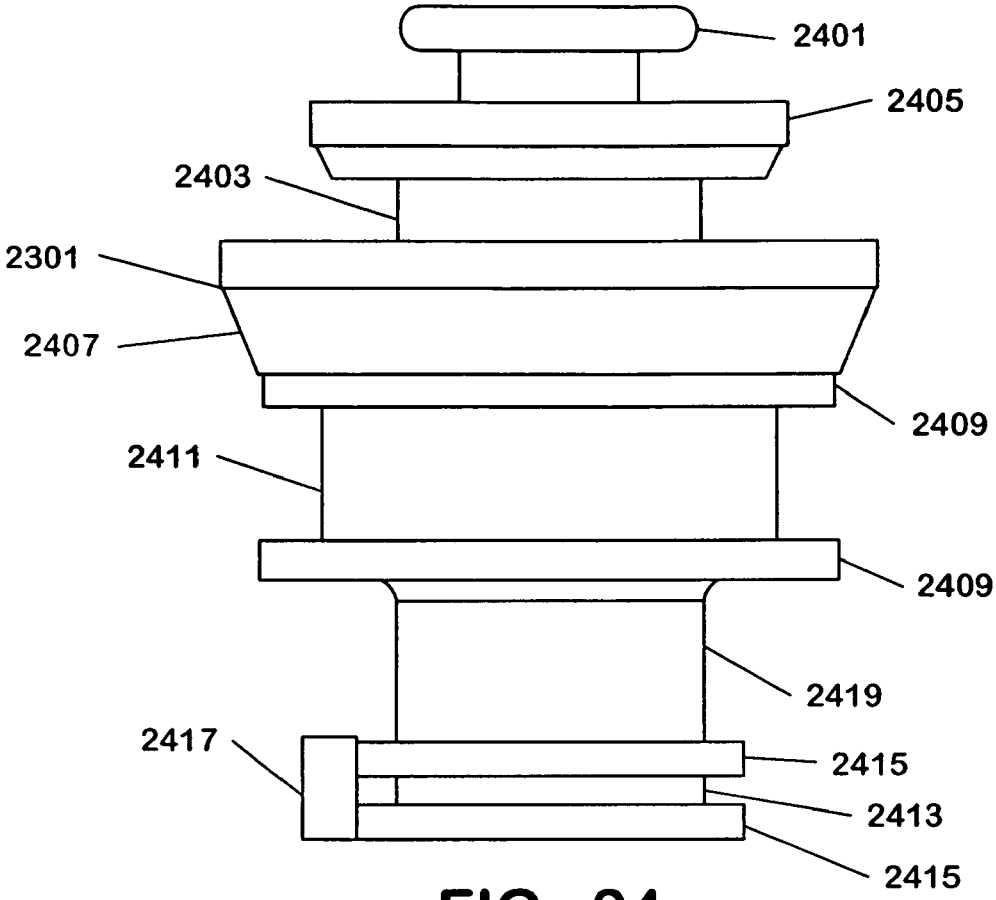
FIG. 24 illustrates a side view of the glow plug connector without a seal and retainer in accordance with the invention.
Figure 25:
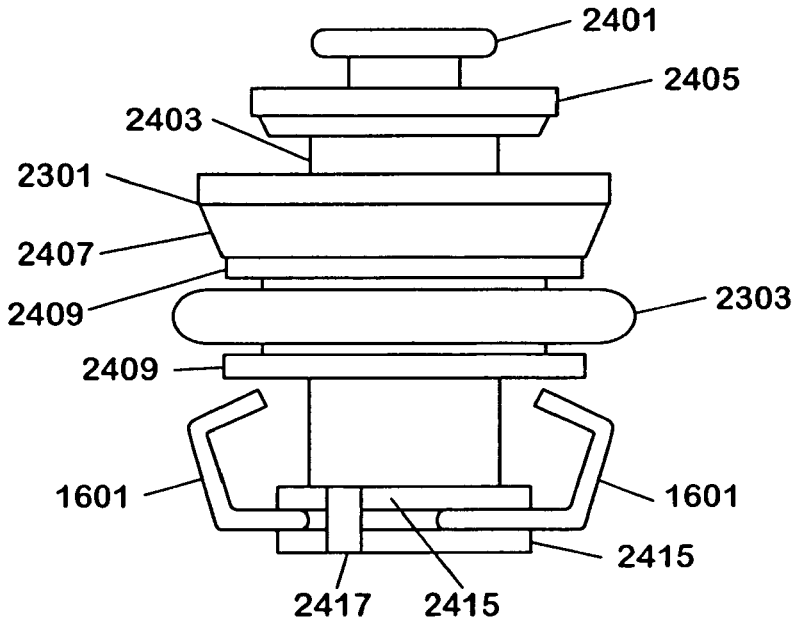
FIG. 25 illustrates a side view of the glow plug connector with a seal and retainer in accordance with the invention.

FIG. 24 illustrates a side view of the glow plug connector 1401 without the seal 2303 and the retainer 1601, and FIG. 25 illustrates a side view of the glow plug connector 1401 with the seal 2303 and the retainer 1601. An upper flange 2401 is encased within a lower portion of the T-connector 1409, as shown in FIG. 14. An installation tool groove 2403 is located between an installation flange 2405 and the stopper 2301 of the connector 1401. An installation tool is inserted into the installation tool groove 2403 in order to assist with the installation and removal of the glow plug connector 1401.

The stopper 2301 is advantageously configured to have an external tapered seating face 2407. The tapered seating face 2407 engages a complimentarily configured top glow plug passage section 816 (shown in FIG. 8) of the rocker carrier 1603 when the glow plug connector 1401 is installed. The O-ring seal 2303 and the tapered seating face 2407 allow the glow plug connectors 1401 to be appropriately sealed in the rocker carrier 1603 and to be properly disposed in the top glow plug passage 816 when the glow plug connectors 1401 are installed.

Figure 1:
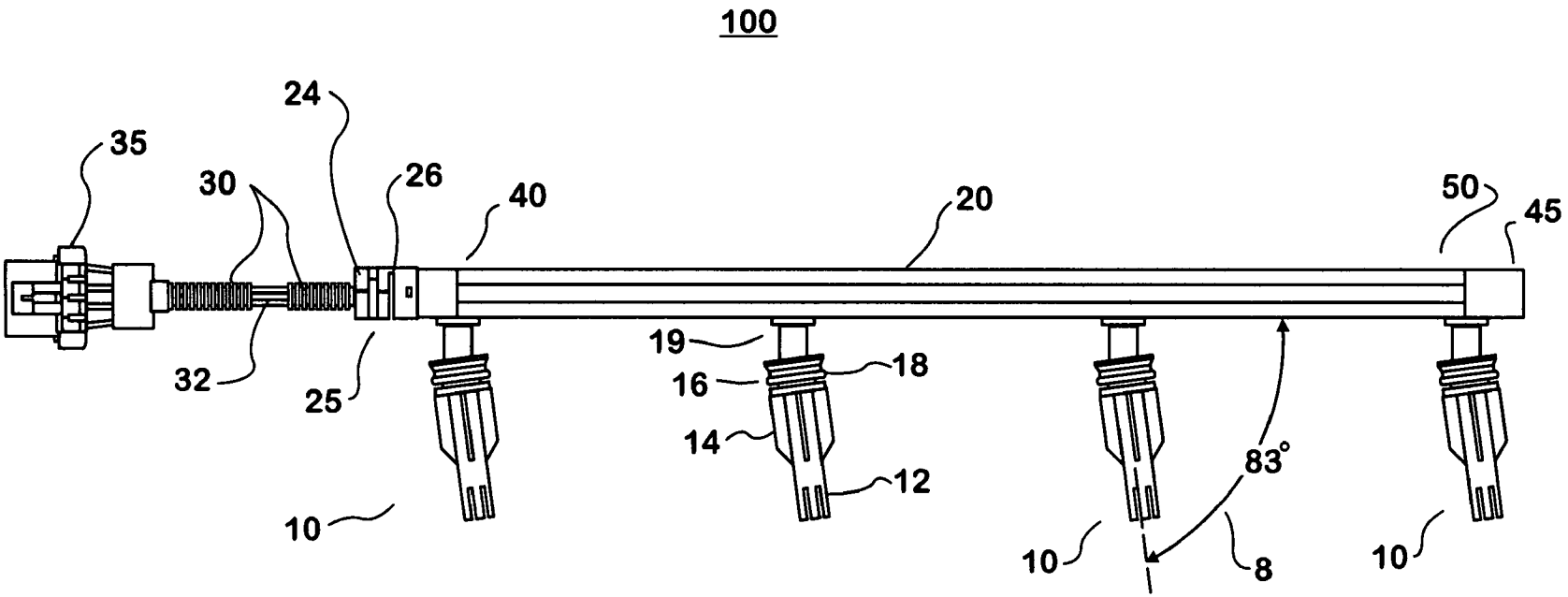
Figure 8:
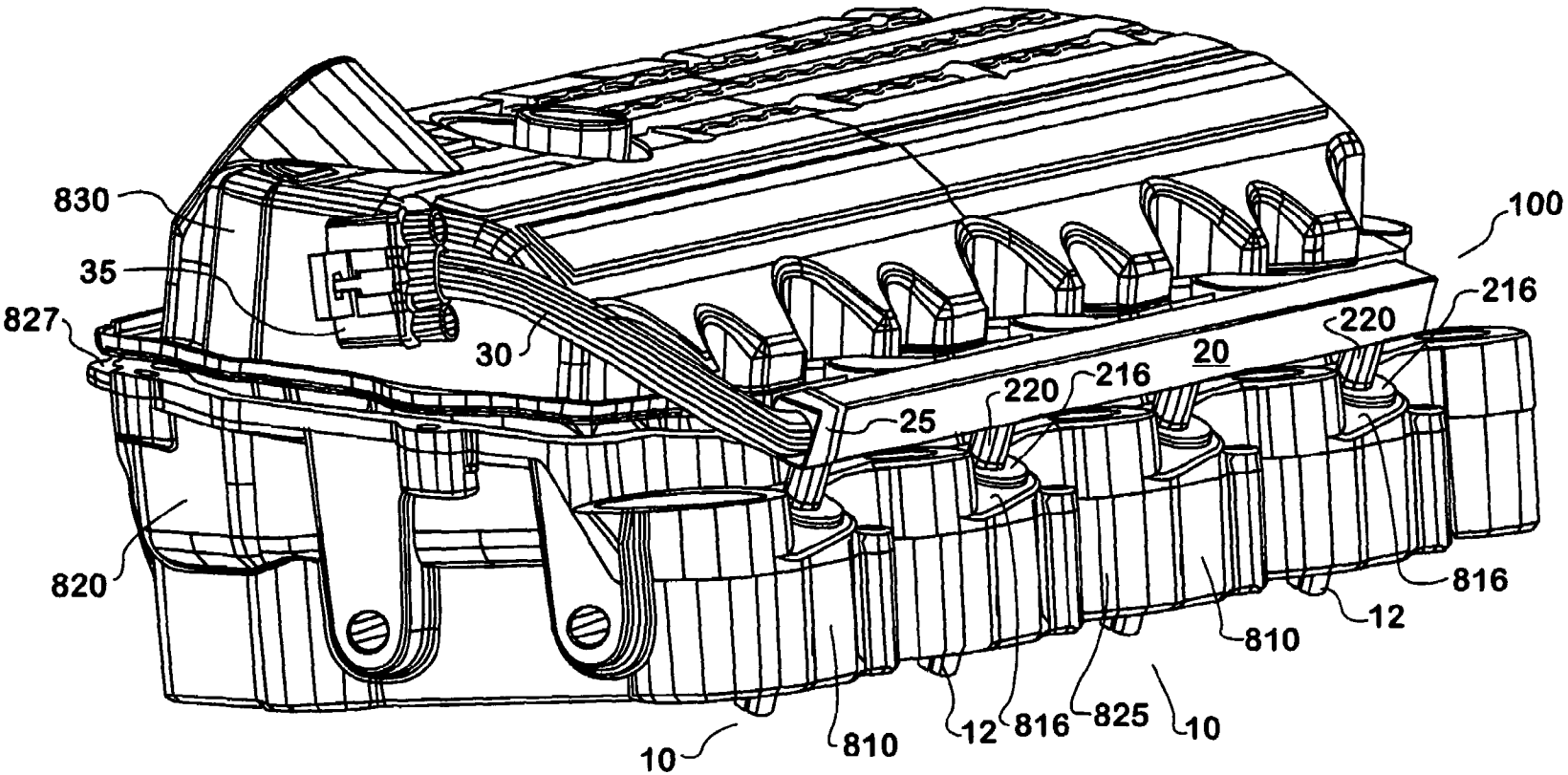
Figure 9:
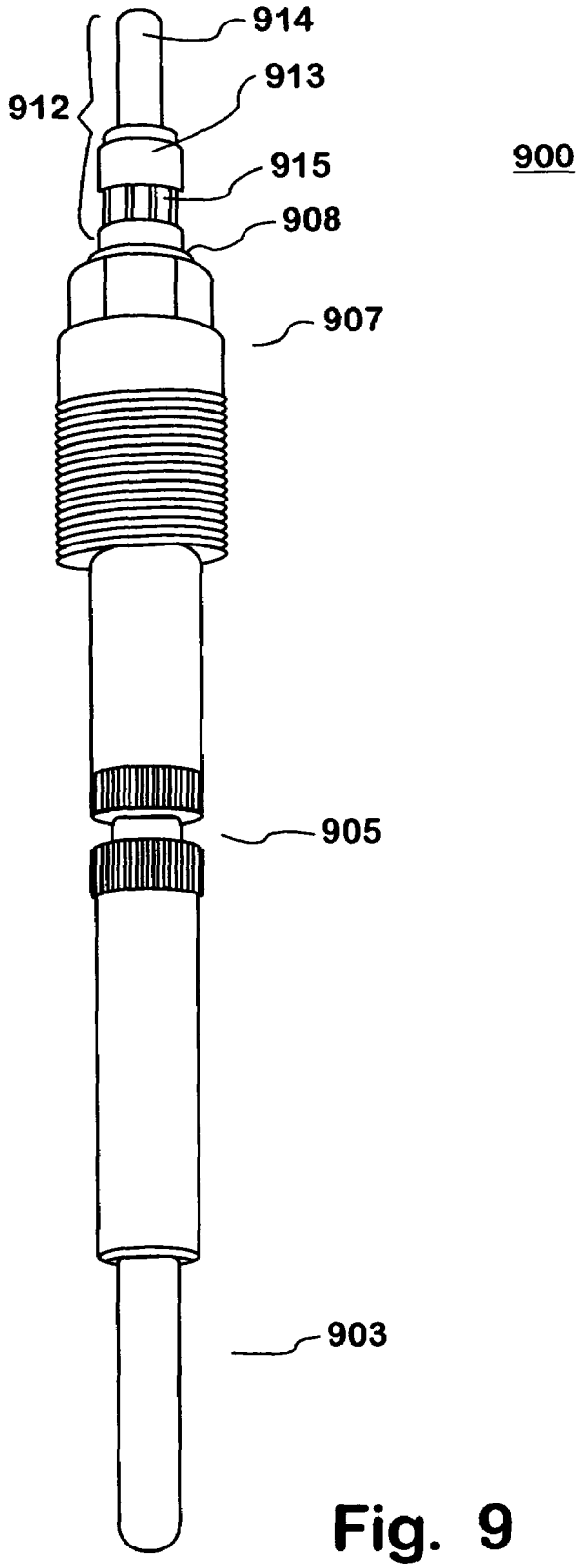
Figure 10:
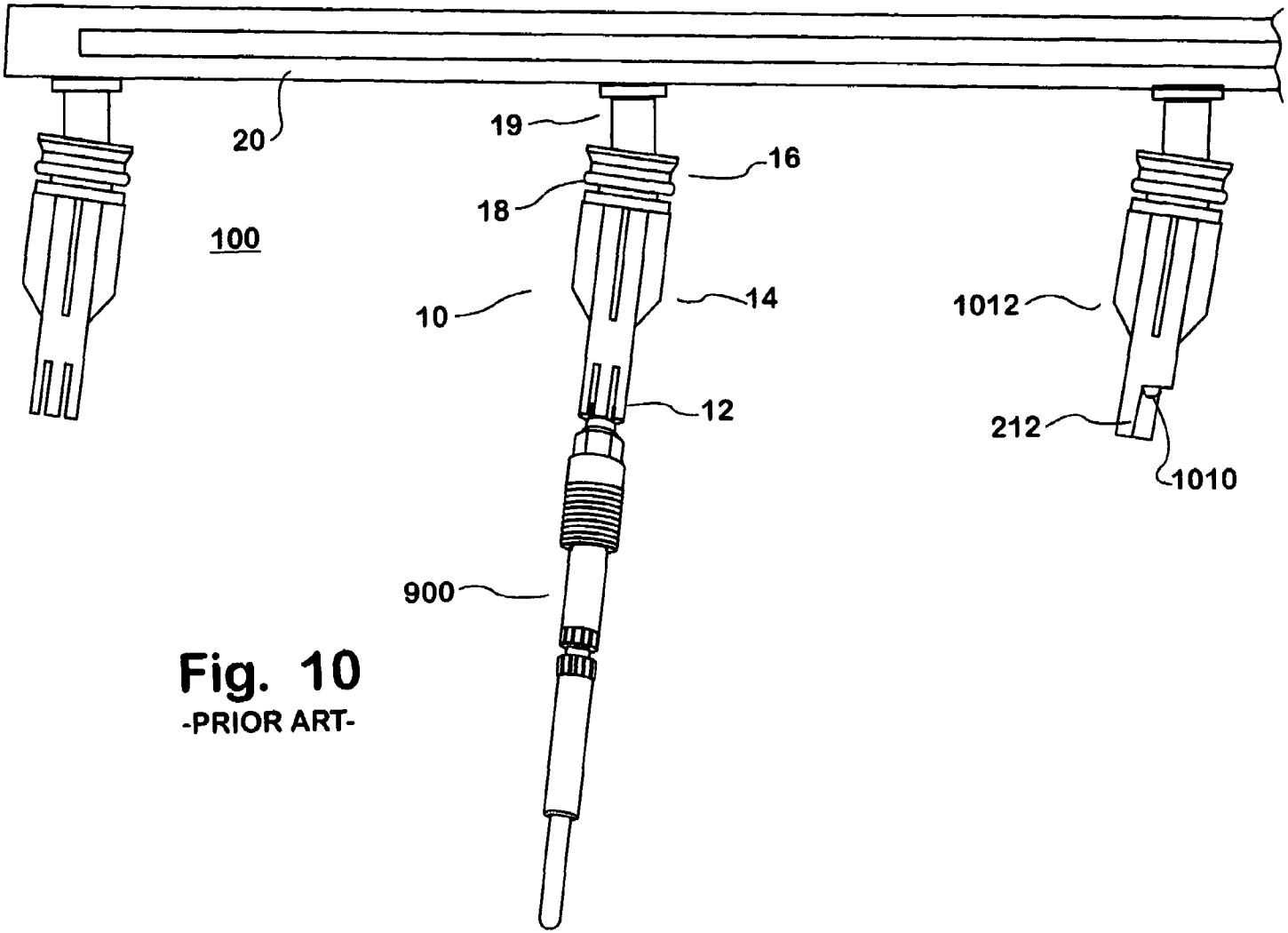
Figure 11:
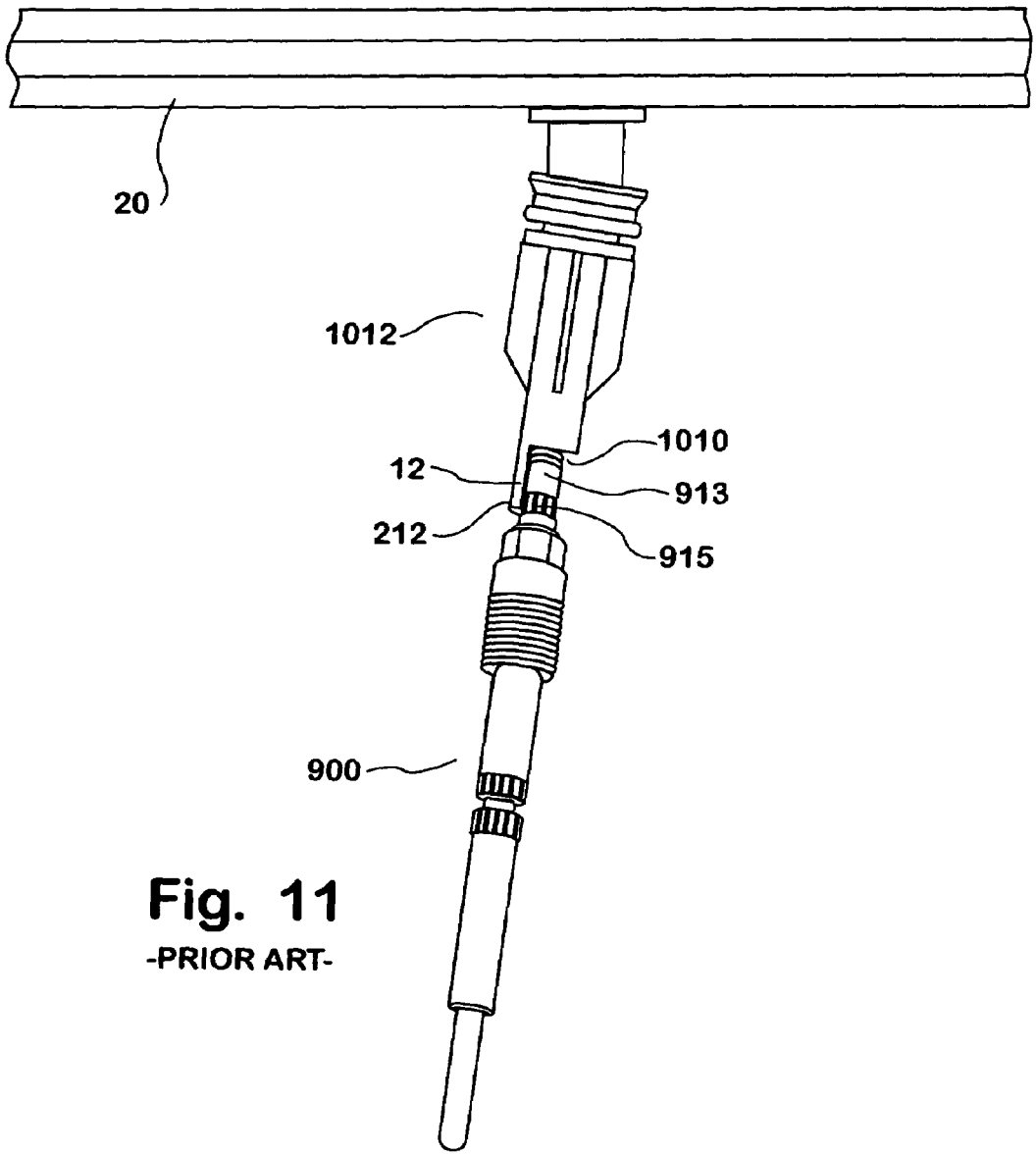
Figures 12, 13:
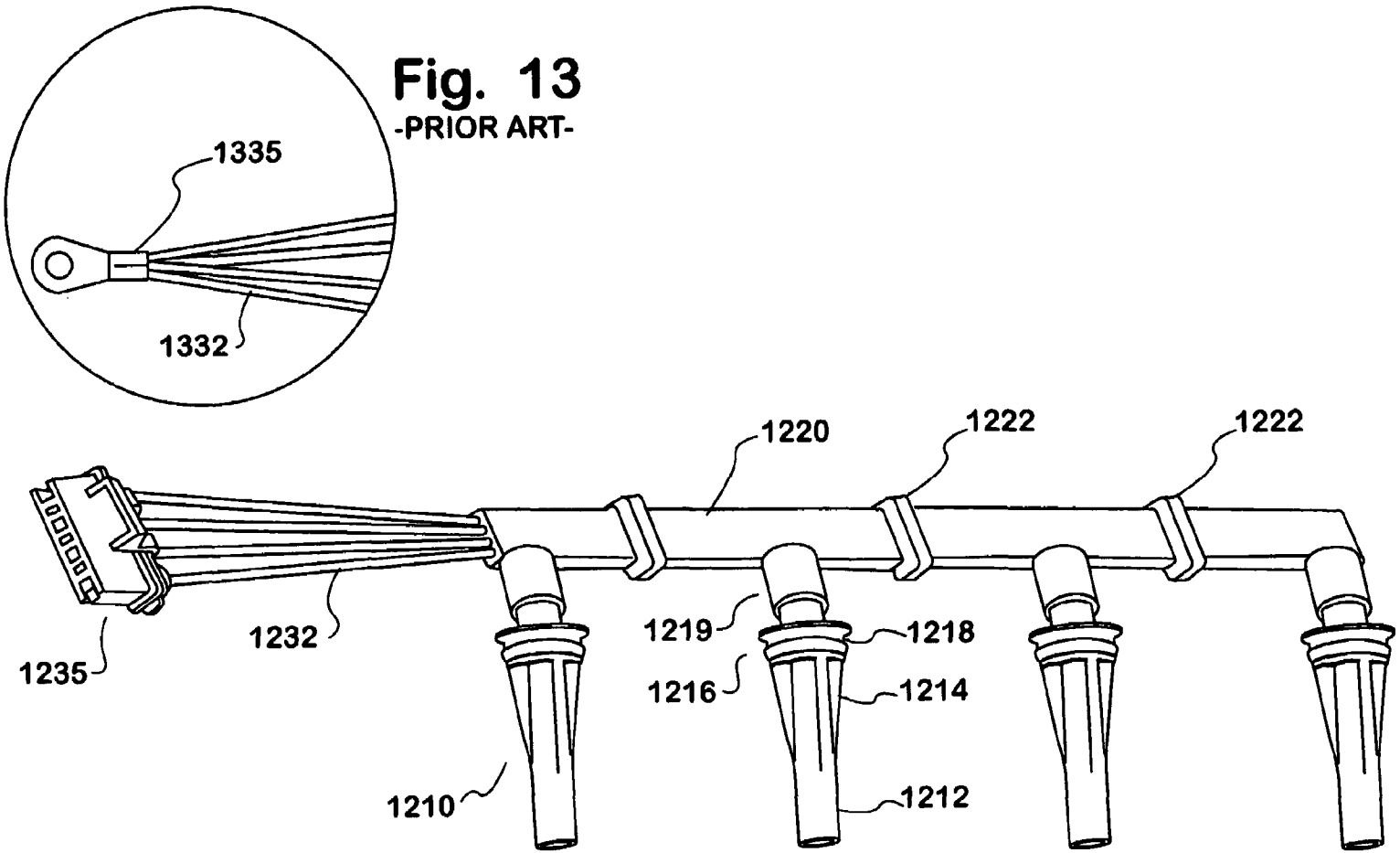

A pair of seal flanges 2409 and a seal groove 2411 are configured to hold an O-ring type seal 2303 as shown in FIG. 23 and FIG. 25 to seal a glow plug passage 810 (as shown in FIG. 8) in the rocker carrier 1603. The O-ring seal 2303 is advantageously comprised of a rubber-based material, e.g., a Teflon coated Viton O-ring. Other materials may instead be utilized to accomplish the sealing function.

A retainer groove 2413 is disposed between a pair of retainer flanges 2415 such that the retainer 1601 may be disposed in the groove between the retainer flanges 2415. An optional overmold 2417 is provided to secure the retainer 1601 to the connector 1401, thereby preventing the retainer 1601 from becoming dislodged from the connector 1401. A spacer 2419 is disposed between the seal flanges 2409 and the retainer flanges 2415 to provide a suitable length for the glow plug connector 1401 to mate with the glow plug.

Figure 26:
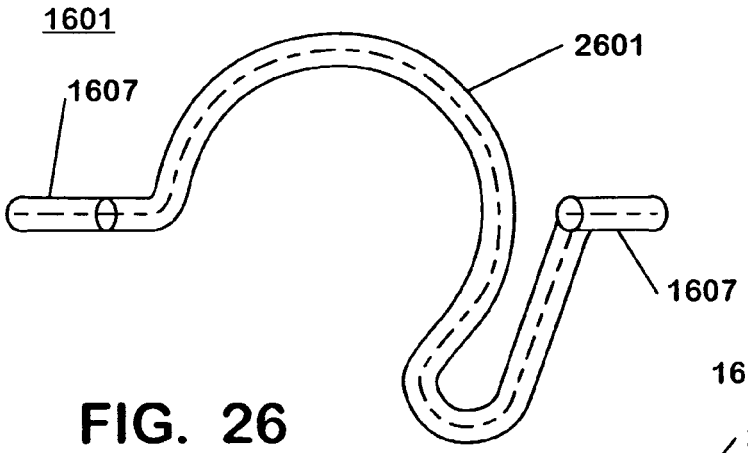
FIG. 26 is a top view of the retainer in accordance with the invention.
Figure 27:
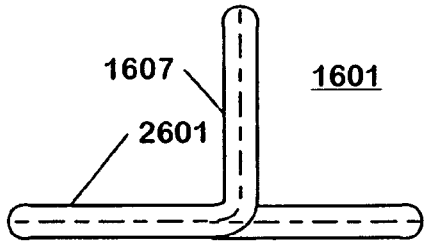
FIG. 27 illustrates retention arms disposed with respect to an expandable spring in accordance with the invention.
Figure 29:
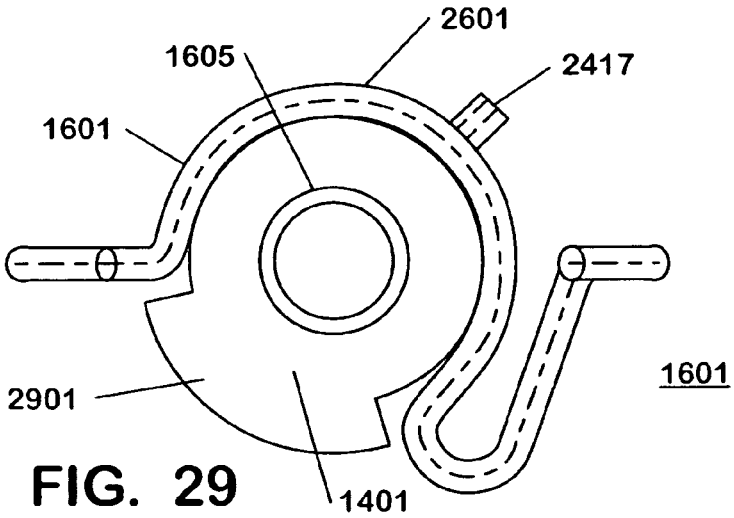
FIG. 29 is a cross-section of the connector as taken through the retainer groove in accordance with the invention.

FIG. 26 illustrates a top view of the retainer 1601. The retainer 1601 is used to positively retain the glow plug connector 1401 in the rocker carrier 1603. The retention arms 1607 are angled on both sides, allowing the retainer 1601 to compress as the glow plug connector 1401 is inserted into the rocker carrier 1603 and to snap back to its full dimensions once inside the engine. The angle on the opposite side allows the connector 1401 to also be removed from the rocker carrier 1603 without damage to either the connector 1401 or the engine. The retainer 1601 is advantageously comprised of a metal or metal alloy that is compressible, expandable, and at least slightly flexible. A retention arm 1607 is disposed at each end of an expandable spring 2601. The expandable spring 2601 expands as it encompasses the retainer groove 2413, then contracts slightly once in place (as shown in FIG. 29). The expandable spring 2601 advantageously has curved section having a partially circular segment at one end and a u-shaped section at the other end. The retention arms 1607 are disposed at each end of the expandable spring 2601. Compression of the retention arms 1607 toward each other compresses the expandable spring 2601, and driving the retention arms 1607 apart expands the expandable spring 2601. The retention arms 1607 are advantageously disposed perpendicular to the expandable spring 2601, as shown in FIG. 27.

Figure 28:
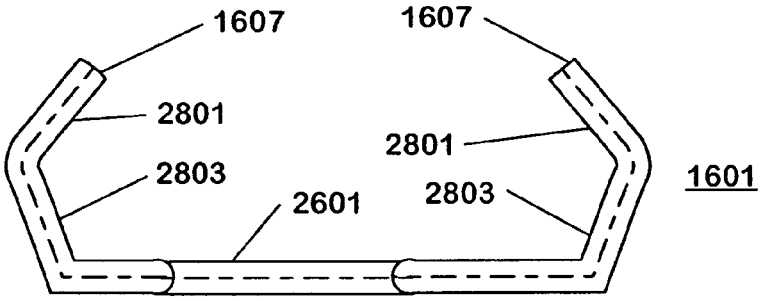
FIG. 28 is a side view of the retainer in accordance with the invention.

FIG. 28 illustrates a side view of the retainer 1601. The retention arms 1607 are shown each comprising an outer member 2801 and an inner member 2803 that are disposed at an angle with respect to each other. The retention arms 1607 may advantageously be disposed in the same plane, and the retention arms 1607 may advantageously be disposed in a plane substantially perpendicular to the plane in which the expandable spring 2601 is disposed. When the glow plug connector 1401 is inserted into the rocker carrier 1603, the inner members 2803 compress such that the retainer 1601 fits within the glow plug passage 810 of the rocker carrier 1603 as the glow plug connector 1401 is inserted. Once the elbow, where the outer member 2801 and inner member 2803 meet, clears the end of the glow plug passage 810, the retention arms 1607 expand and hold the glow plug connector 1401 in the rocker carrier 1603. When the glow plug connector 1401 is removed from the rocker carrier 1603, the outer members 2801 compress such that the retainer 1601 fits within the glow plug passage 810 of the rocker carrier 1603 as the glow plug connector 1401 is removed.

FIG. 29 shows a cross-section of the connector as taken through the retainer groove 2413, when the retainer 1601 is disposed on the connector 1401. The retainer groove 2413 advantageously runs only partially around the outer diameter of the glow plug connector 1401 between the retainer flanges 2415. A retainer locator 2901 between the retainer flanges 2415 is utilized to orient the retainer 1601 to the glow plug connector 1401, with a certain amount of play between the retainer 1601 and the retainer locator 2901.

The present invention provides the advantage of positively connecting glow plug connectors within a rocker carrier by use of a retainer. The retainer is flexible, which facilitates installation and removal, in addition to securing the glow plug connector within the rocker carrier. Installation and removal are facilitated by providing a groove in which an installation tool may be inserted. The apparatus may be utilized in other applications than glow plug connection.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A glow plug connector comprising:

a glow plug terminal;

a first retainer flange and a second retainer flange;

a retainer disposed between the first retainer flange and the second retainer flange, wherein the retainer is capable of compressing to fit within a passage of a rocker carrier and capable of subsequently expanding to prevent the glow plug connector from being dislodged from the rocker carrier.

2. The glow plug connector of claim 1, wherein the retainer is comprised of at least one retention arm including an outer member disposed at an angle from an inner member, wherein the at least one retention arm is compressible.

3. The glow plug connector of claim 1, wherein the retainer is comprised of an expandable spring having a first end and a second end, and wherein a first retention arm is disposed at the first end and a second retention arm is disposed at the second end.

4. The glow plug connector of claim 1, wherein the retainer is comprised of an expandable spring having a curved section, a first end, and a second end, wherein the curved section comprises a partial ring section and a u-shaped section, and wherein a first retention arm is disposed at the first end and a second retention arm is disposed at a second end.

5. The glow plug connector of claim 1, further comprising an installation tool groove disposed adjacent to an installation flange.

6. The glow plug connector of claim 1, further comprising an overmold disposed adjacent to the first retainer flange and the second retainer flange such that the retainer is secured in a groove between the first retainer flange, the second retainer flange, and the overmold.

7. The glow plug connector of claim 1, further comprising a stopper capable of compressing within an opening of a rocker carrier.

8. The glow plug connector of claim 1, further comprising:

a first seal flange and a second seal flange separated by a seal groove;

a seal disposed in the seal groove.

9. An apparatus comprising:

an electrical terminal;

a first retainer flange and a second retainer flange;

a retainer disposed between the first retainer flange and the second retainer flange, wherein the retainer is capable of compressing to fit within a passage of an internal combustion engine and capable of subsequently expanding to prevent the apparatus from being dislodged from the internal combustion engine;

wherein the retainer comprises a first compressible retention arm disposed at a first end of a curved section that comprises a partially circular segment at the first end and a u-shaped section at a second end the curved section, and wherein a second compressible retention arm is disposed at the second end the curved section such that compression of the first compressible retention arm and the second compressible retention arm compresses the curved section.

10. The apparatus of claim 9, wherein the retainer is comprised of at least one retention arm including an outer member disposed at an angle from an inner member, wherein the at least one retention arm is compressible.

11. The apparatus of claim 9, further comprising an installation tool groove disposed adjacent to an installation flange.

12. The apparatus of claim 9, further comprising an overmold disposed adjacent to the first retainer flange and the second retainer flange such that the retainer is secured in a groove between the first retainer flange, the second retainer flange, and the overmold.

13. The apparatus of claim 9, further comprising a stopper capable of compressing within an opening of a rocker carrier.

14. The glow plug connector of claim 9, further comprising:

a first seal flange and a second seal flange separated by a seal groove;

a seal disposed in the seal groove.

15. A retainer comprising:

an expandable spring comprising a partially circular segment adjacent to a u-shaped section, wherein the partially circular segment is capable of surrounding a part of a connector;

a first compressible retention arm disposed at a first end of the expandable spring;

a second compressible retention arm disposed at a second end of the expandable spring;

wherein bringing the first compressible retention arm and the second compressible retention arm together compresses the expandable spring;

wherein driving the first compressible retention arm and the second compressible retention arm apart causes the expandable spring to expand.

16. The retainer of claim 15, wherein the retainer is comprised of at least one retention arm including an outer member disposed at an angle from an inner member, wherein the at least one retention arm is compressible.

17. A retainer comprising:

an expandable spring having a curved section capable of being disposed within a groove of a connector and having a first end and a second end;

a first flexible retention arm, disposed at the first end and oriented substantially in a plane perpendicular to a plane in which the expandable spring is disposed, having an inner member disposed at a first angle outwardly from the expandable spring and an outer member disposed at a second angle inwardly toward the expandable spring, such that the inner member and the outer member form an elbow.

18. The retainer of claim 17, further comprising a second flexible retention arm, disposed at the second end and oriented substantially in the plane perpendicular to the plane in which the expandable spring is disposed, having an inner member disposed at a third angle outwardly from the expandable spring and an outer member disposed at a fourth angle inwardly toward the expandable spring, such that the inner member and the outer member form an elbow.

19. The retainer of claim 17, wherein the expandable spring comprises two or more at least partial loops.

* * * * *